US008062240B2

(12) United States Patent
Chiang

(10) Patent No.: US 8,062,240 B2
(45) **Date of Patent: *Nov. 22, 2011**

(54) MASSAGE DEVICE

(75) Inventor: Chi-Wu Chiang, Taichung (TW)

(73) Assignee: Weightec Electronic Technology Co., Ltd., Dongguan, Dongguan Province (CN)

( * ) Notice: Subject to any disclaimer, the term of this patent is extended or adjusted under 35 U.S.C. 154(b) by 794 days.

This patent is subject to a terminal disclaimer.

(21) Appl. No.: 12/103,785

(22) Filed: Apr. 16, 2008

(65) Prior Publication Data

US 2009/0227915 A1 Sep. 10, 2009

(30) Foreign Application Priority Data

Jan. 15, 2008 (CN) ..... 2008 2 0091616

(51) Int. Cl.
*A61H 7/00* (2006.01)
*A61H 15/00* (2006.01)
*A61H 19/00* (2006.01)

(52) U.S. Cl. ..... 601/98; 601/90; 601/112

(58) Field of Classification Search ..... 601/49, 601/56–60, 84–87, 90, 91, 93, 94, 97–101, 601/103, 112, 113, 115, 116, 124, 126, 127, 601/133–136

See application file for complete search history.

(56) References Cited

U.S. PATENT DOCUMENTS

| | | | | |
|---|---|---|---|---|
| 3,207,152 | A | 9/1965 | Thornton | |
| 3,800,785 | A | 4/1974 | Inada | |
| 5,020,518 | A | 6/1991 | Spears et al. | |
| 5,630,790 | A | 5/1997 | Ito | |
| 5,807,288 | A | 9/1998 | Wu | |
| 7,128,721 | B2 | 10/2006 | Ferber et al. | |
| 7,306,570 | B1 | 12/2007 | Julian | |
| 7,731,672 | B2 * | 6/2010 | Chiang | 601/112 |
| 2003/0018284 | A1 | 1/2003 | Lim | |
| 2004/0049136 | A1 | 3/2004 | Lin | |
| 2004/0171972 | A1 | 9/2004 | Shimizu et al. | |
| 2005/0015029 | A1 | 1/2005 | Kim | |
| 2005/0020946 | A1 | 1/2005 | Kim | |
| 2005/0090770 | A1 | 4/2005 | Chen | |
| 2005/0096571 | A1 | 5/2005 | Miki | |
| 2005/0113723 | A1 | 5/2005 | Ueyama et al. | |
| 2006/0069331 | A1 | 3/2006 | Huang | |
| 2007/0118059 | A1 | 5/2007 | Luo | |
| 2008/0161736 | A1 | 7/2008 | Leifer | |

FOREIGN PATENT DOCUMENTS

| | | | |
|---|---|---|---|
| CN | 201244170 | T | 5/2009 |
| CN | 201469637 | U | 5/2010 |
| EP | 0809993 | A2 | 12/1997 |
| EP | 1145701 | A1 | 10/2001 |
| EP | 1400230 | A1 | 3/2004 |

(Continued)

*Primary Examiner* — Justine Yu
*Assistant Examiner* — Kristen Matter
(74) *Attorney, Agent, or Firm* — Morris Manning & Martin LLP; Tim Tingkang Xia, Esq.

(57) ABSTRACT

The present invention relates to a massage device. In one embodiment, the massage device includes a massage assembly and a transmission assembly for driving the massage assembly to provide massage effects. The massage assembly include a pair of massage members. Each massage member has a driving member having an eccentric wheel and an eccentric block, a massage bracket engaged with the driving member and a plurality of massage heads attached to the massage bracket.

28 Claims, 11 Drawing Sheets

FOREIGN PATENT DOCUMENTS

| | | | |
|---|---|---|---|
| EP | 1568344 | A2 | 8/2005 |
| EP | 1595521 | A1 | 11/2005 |
| EP | 2080499 | A1 | 7/2009 |
| JP | 2000051302 | A | 2/2000 |
| WO | 01/60310 | A1 | 8/2001 |
| WO | 02/069880 | A1 | 9/2002 |
| WO | 02/094169 | A2 | 11/2002 |
| WO | 2008/036955 | A2 | 3/2008 |

* cited by examiner

200

250

MASSAGE DEVICE

CROSS-REFERENCE TO RELATED PATENT APPLICATION

This application claims priority to and the benefit of, pursuant to 35 U.S.C. §119(a), Chinese patent application Serial No. 200820091616.4, filed Mar. 7, 2008, entitled "A Massage Device," by Chi-Wu Chiang, which is incorporated herein by reference in its entirety.

FIELD OF THE INVENTION

The present invention relates generally to a massage device, and more particularly to a massage device that utilizes a gyro mechanism to provide massaging effects.

BACKGROUND OF THE INVENTION

Simulated massaging or kneading of parts of the body to aid circulation or relax the muscles has gained popularity, particularly, among people who are lack of exercise. The simulated massaging or kneading effects can be achieved electromagnetically and/or mechanically by means of a massage device. For the electromagnetic massaging or kneading, such a massage device is configured to generate a series of electromagnetic pulses, which are regularly directed to parts of interest of the body so as to perform massaging or kneading thereon. However, the massaging or kneading area of the massage device is limited, and the massaging or kneading effects may not be very gentle.

For the mechanical massaging or kneading, the massage device is usually designed to have a plurality of massage nodes and a driving system to drive the plurality of massage nodes to rotate so as to simulate massaging or kneading when applied to parts of interest of the body. Comparing to the electromagnetic massaging, the limitation of the massaging or kneading area is improved for the mechanical massaging. However, mechanical massage devices are relatively complex and costly.

Therefore, a heretofore unaddressed need exists in the art to address the aforementioned deficiencies and inadequacies.

SUMMARY OF THE INVENTION

The present invention, in one aspect, relates to a massage device. In one embodiment, the massage device includes a base cover having a longitudinal axis and a plurality of guiding rails formed parallel to the longitudinal axis, and a rack mounted to the base cover and paralleled to the plurality of guiding rails.

The massage device further includes a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

The massage device also includes a transmission assembly received in the chamber and secured in the carriage. The transmission assembly includes a motor having an output shaft, a worm mechanically coupled with the output shaft of the motor, a pair of worm wheels meshing with the worm, a first gear coaxially mounted under one of the pair of worm wheels, a second gear meshing with the first gear, a pinion gear coaxially extended under the second gear, a third gear meshing with the pinion gear, and a driving gear coaxially extended under the third gear and meshing with the rack such that when the motor is activated, it drives the worm to rotate, the rotation of the worm results in, in turn, the rotations of the pair of worm wheels, the first gear, the second gear, the pinion gear, the third gear and the driving gear, thereby moving the carriage along the plurality of the guiding rails of the base cover.

Moreover, the massage device includes a massage assembly having a pair of massage members. Each massage member has a gear shaft, a driving member, a massage bracket, a plurality of massage heads, and a U-shape fixture.

The gear shaft has a first end portion and an opposite, second end portion. The gear shaft extends through the shield member of the carriage and is coaxially mounted to the corresponding worm wheel by the first end portion.

The driving member includes an eccentric wheel and an eccentric block. The eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion. The first cylindrical portion has a central axis substantially perpendicular to the first planar surface, and a diameter, $d_1$. The second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion. The shaft bore has a central axis substantially coincident with the central axis of the first cylindrical portion.

The eccentric block has a first planar surface and a second planar surface defining a cylinder body therebetween. The cylinder body has a central axis and a diameter, $d_3$, greater than the diameter $d_2$ of the second cylindrical portion of the eccentric wheel, and the first planar surface is tilted to the second planar surface at an angle $\gamma$.

In one embodiment, each of the angles $\alpha$, $\beta$ and $\gamma$ is greater than zero but less than 90°, preferably, greater than zero but less than 45°. In one embodiment, $\beta=\alpha$ and $\gamma=\alpha$.

The massage bracket includes a first surface and an opposite, second surface defining a bracket body therebetween, a central axis, a protrusion laterally extending from the bracket body, and a plurality of stumps spaced-apart on the first surface, wherein the bracket body defines an opening therethrough.

In one embodiment, each of the plurality of massage heads has a mushroom-shape. Each of the plurality of massage heads has a first structure, a mushroom-shape node and a second structure placed between the first structure and the mushroom-shape node. In one embodiment, each of the plurality of massage heads includes an energy source of capable of generating thermal energy. The source energy may include a lamp base mounted to the corresponding one of the plurality of stumps, a PCB board attached to the lamp base, and heating lamps attached onto the PCB board.

As assembled, each of the plurality of massage heads is attached to a corresponding one of the plurality of stumps of the massage bracket, respectively. The second cylindrical portion of the eccentric wheel is received in the opening of the massage bracket. The eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel. Additionally, the protrusion of the massage bracket is received in the U-shape fixture that in turn, is mounted to the shield member of the carriage. The second end portion of the gear shaft is received in the shaft bore.

In operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

In another aspect, the present invention relates to a massage device. In one embodiment, the massage device includes a base cover, a rack, a carriage, a transmission assembly and a massage assembly.

The base cover has a longitudinal axis and a plurality of guiding rails formed parallel to the longitudinal axis. The rack is mounted to the base cover and paralleled to the plurality of guiding rails.

The carriage includes a chassis member and a shield member placed over the chassis member to form a chamber therebetween. The chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

The transmission assembly is received in the chamber and secured in the carriage. In one embodiment, the transmission assembly includes a motor having an output shaft, a worm mechanically coupled with the output shaft of the motor, a pair of first worm wheels meshing with the worm, a pair of second worm wheels each meshing with one of the pair of first worm wheels, a first gear coaxially mounted under one of the pair of second worm wheels, a second gear meshing with the first gear, a third gear meshing with both the second gear and the rack. For such a arrangement, when the motor is activated, it drives the worm to rotate, the rotation of the worm results in, in turn, the rotations of the pair of worm wheels, the first gear, the second gear, the pinion gear, the third gear and the driving gear, thereby moving the carriage along the plurality of the guiding rails of the base cover.

The massage assembly has a pair of massage members. Each massage member includes:

(i). a gear shaft having a first end portion and an opposite, second end portion, where the gear shaft extends through the shield member of the carriage and is coaxially mounted to a corresponding second worm wheel by the first end portion, (ii). a driving member having an eccentric wheel and an eccentric block, where the eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, where the first cylindrical portion has a central axis substantially perpendicular to the first planar surface, and a diameter, $D_1$, where the second cylindrical portion has a central axis substantially perpendicular to the second planar surface and defining an angle $\alpha$, relative to the central axis of the first cylindrical portion, and a diameter, $D_2$, less than the diameter $D_1$ of the first cylindrical portion, and where the shaft bore has a central axis substantially coincident with the central axis of the first cylindrical portion, and where the eccentric block has a first planar surface and a second planar surface defining a cylinder body therebetween, where the cylinder body has a central axis and a diameter, $D_3$, greater than the diameter $D_2$ of the second cylindrical portion of the eccentric wheel, and the first planar surface is tilted to the second planar surface at an angle $\gamma$, (iii). a massage bracket having a first surface and an opposite, second surface defining a bracket body therebetween, a central axis and a plurality of stumps spaced-apart on the first surface, where the bracket body defines a first opening in the central region and a second opening in a region apart from the central region, (iv). a plurality of massage heads, and (v). a fixture bar.

As assembled, the plurality of massage heads is attached to the plurality of stumps of the massage bracket, respectively. The second cylindrical portion of the eccentric wheel is received in the first opening of the massage bracket. The eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel. The fixture bar is received in the second opening of the massage bracket and mounted to the shield member of the carriage at its one end. Additionally, the second end portion of the gear shaft is received in the shaft bore.

In operation, the motor drives the pair of first worm wheels to rotate in opposed rotational directions, which in turn, drives the carriage to move along the plurality of the guiding rails of the base cover and the driving member of the massage assembly to rotate. The rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

In one embodiment, each of the plurality of massage heads has a mushroom-shape. Each of the plurality of massage heads has a first structure, a mushroom-shape node and a second structure placed between the first structure and the mushroom-shape node. In one embodiment, each of the plurality of massage heads includes an energy source of capable of generating thermal energy. The source energy may include a lamp base mounted to the corresponding one of the plurality of stumps, a PCB board attached to the lamp base, and heating lamps attached onto the PCB board.

In yet another aspect, the present invention relates to a massage device. In one embodiment, the massage device includes a massage assembly having a pair of massage members. Each massage member has a driving member having an eccentric wheel and an eccentric block, a massage bracket and a plurality of massage heads.

The eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion. The first cylindrical portion has a central axis substantially perpendicular to the first planar surface, and a diameter, $d_1$. The second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion. The shaft bore has a central axis substantially coincident with the central axis of the first cylindrical portion.

The eccentric block has a first planar surface and a second planar surface defining a cylinder body therebetween. The cylinder body has a central axis and a diameter, $d_3$, greater than the diameter $d_2$ of the second cylindrical portion of the eccentric wheel, and the first planar surface is tilted to the second planar surface at an angle $\gamma$.

The massage bracket has a first surface and an opposite, second surface defining a bracket body therebetween, a central axis and a plurality of stumps spaced-apart on the first surface. The bracket body defines an opening therethrough in the central region.

As assembled, each of the plurality of massage heads is attached to a corresponding one of the plurality of stumps of the massage bracket, respectively, the second cylindrical portion of the eccentric wheel is received in the opening of the massage bracket. The eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

Furthermore, the massage device includes a base cover having a longitudinal axis and a plurality of guiding rails formed parallel to the longitudinal axis, and a rack mounted to the base cover and paralleled to the plurality of guiding rails.

The massage device also includes a carriage having a chassis member and a shield member placed over the chassis member to form a chamber therebetween. The chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

Moreover, the massage device includes a transmission assembly adapted for driving the plurality of massage heads to move alternatively along a first direction parallel to the central axis of the first cylindrical portion of the eccentric wheel, while translating the massage assembly along a second direction perpendicular to the first direction. The transmission assembly is received in the chamber and secured in the carriage. In one embodiment, the transmission assembly includes a motor having an output shaft, a worm mechanically coupled with the output shaft of the motor, a pair of worm wheels meshing with the worm, a first gear coaxially mounted under one of the pair of worm wheels, a second gear meshing with the first gear, a pinion gear coaxially extended under the second gear, a third gear meshing with the pinion gear, and a driving gear coaxially extended under the third gear and meshing with the rack such that when the motor is activated, it drives the worm to rotate, the rotation of the worm results in, in turn, the rotations of the pair of worm wheels, the first gear, the second gear, the pinion gear, the third gear and the driving gear, thereby moving the carriage along the plurality of the guiding rails of the base cover.

In one embodiment, each massage member may include a gear shaft having a first end portion and an opposite, second end portion. The gear shaft extends through the shield member of the carriage and is coaxially mounted to the corresponding worm wheel by the first end portion, while secured into the shaft bore of the eccentric wheel by the second end portion.

In another embodiment, each massage member may include means for limiting the massage bracket from rotating along the central axis of the first cylindrical portion of the eccentric wheel. The limiting means comprises a U-shape fixture or a fixture bar mounted to the shield member of the carriage.

For such a massage device, in operation, the motor drives the pair of worm wheels to rotate in opposed rotational directions, which in turn, drives the carriage to move along the plurality of the guiding rails of the base cover and the driving member of the massage assembly to rotate. The rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

In a further aspect, the present invention relates to a massage assembly usable for a massage device. In one embodiment, each massage member includes an eccentric wheel, an eccentric block, a massage bracket, and a plurality of massage heads.

In one embodiment, the eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion. The first cylindrical portion has a central axis substantially perpendicular to the first planar surface, and a diameter, $d_1$. The second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion. The shaft bore has a central axis substantially coincident with the central axis of the first cylindrical portion.

The eccentric block has a first planar surface and a second planar surface defining a cylinder body therebetween. The cylinder body has a central axis and a diameter, $d_3$, greater than the diameter $d_2$ of the second cylindrical portion of the eccentric wheel, and the first planar surface is tilted to the second planar surface at an angle $\gamma$.

The massage bracket has a first surface and an opposite, second surface defining a bracket body therebetween, a central axis and a plurality of stumps spaced-apart on the first surface, where the bracket body defines an opening therethrough in the central region.

As assembled, the plurality of massage heads is attached to the plurality of stumps of the massage bracket, respectively, the second cylindrical portion of the eccentric wheel is received in the opening of the massage bracket. The eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

The massage assembly may further include means for limiting the massage bracket from rotating along the central axis of the first cylindrical portion of the eccentric wheel. The limiting means includes a U-shape fixture or a fixture bar.

In yet a further aspect, the present invention relates to a massage assembly usable for a massage device. The massage assembly includes a wheel member having a first surface, a second surface tilted at least to a part of the first surface, a third surface, a first body portion defined between the first surface and the second surface, a second body portion defined between the second surface and the third surface, and a shaft bore defined through the first body portion and the second body portion. The first body portion has a central axis relative to the first surface. The second body portion has a central axis relative to the second surface and defining an angle $\alpha$ relative to the central axis of the first body portion. The shaft bore has a central axis substantially coincident with the central axis of the first body portion.

The massage assembly also includes a block member has a first surface that is configured to cooperate with the third surface of the wheel member and a second surface defining a body portion therebetween. The body portion has a central axis, and the first surface is tilted at least to a part of the second surface.

The massage assembly also further includes a massage bracket and at least one massage head. The massage bracket has a first surface and an opposite, second surface defining a bracket body therebetween, a central axis and at least one stump on the first surface. The bracket body defines an opening therethrough.

As assembled, the at least one massage head is attached to the at least one stump of the massage bracket, the second body portion of the wheel member is received in the opening of the massage bracket, the block member is mounted to the second body portion of the wheel member such that the first surface of the block member is in contact with the third surface of the wheel member, the central axis of the body portion of the block member is substantially coincident with the central axis of the first body portion of the wheel member, the central axis of the massage bracket is substantially coincident with the central axis of the second body portion of the wheel member, and the massage bracket operably cooperates with the second body portion of the wheel member.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
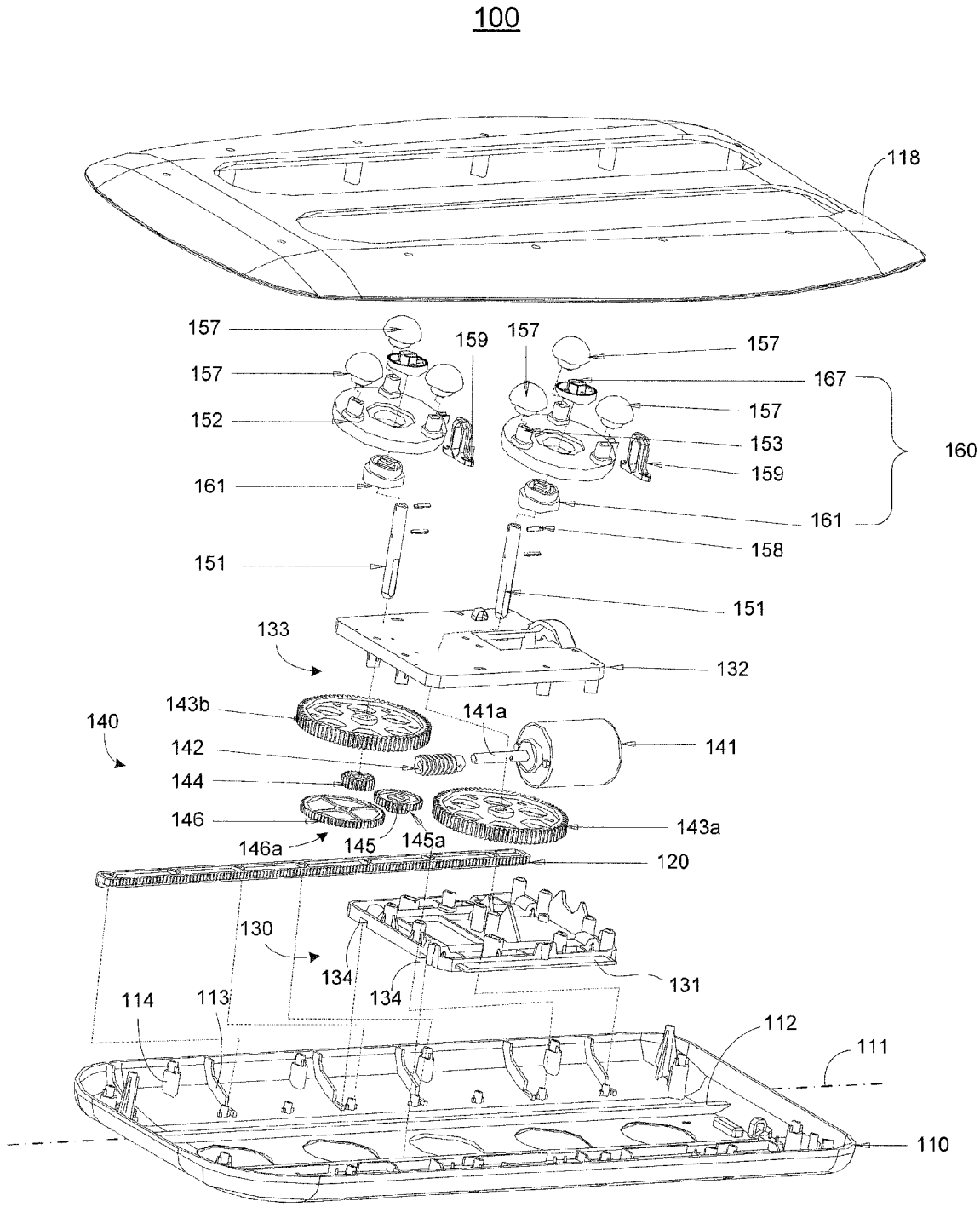
FIG. 1 shows an exploded view of a massage device according to one embodiment of the present invention.
Figure 2:
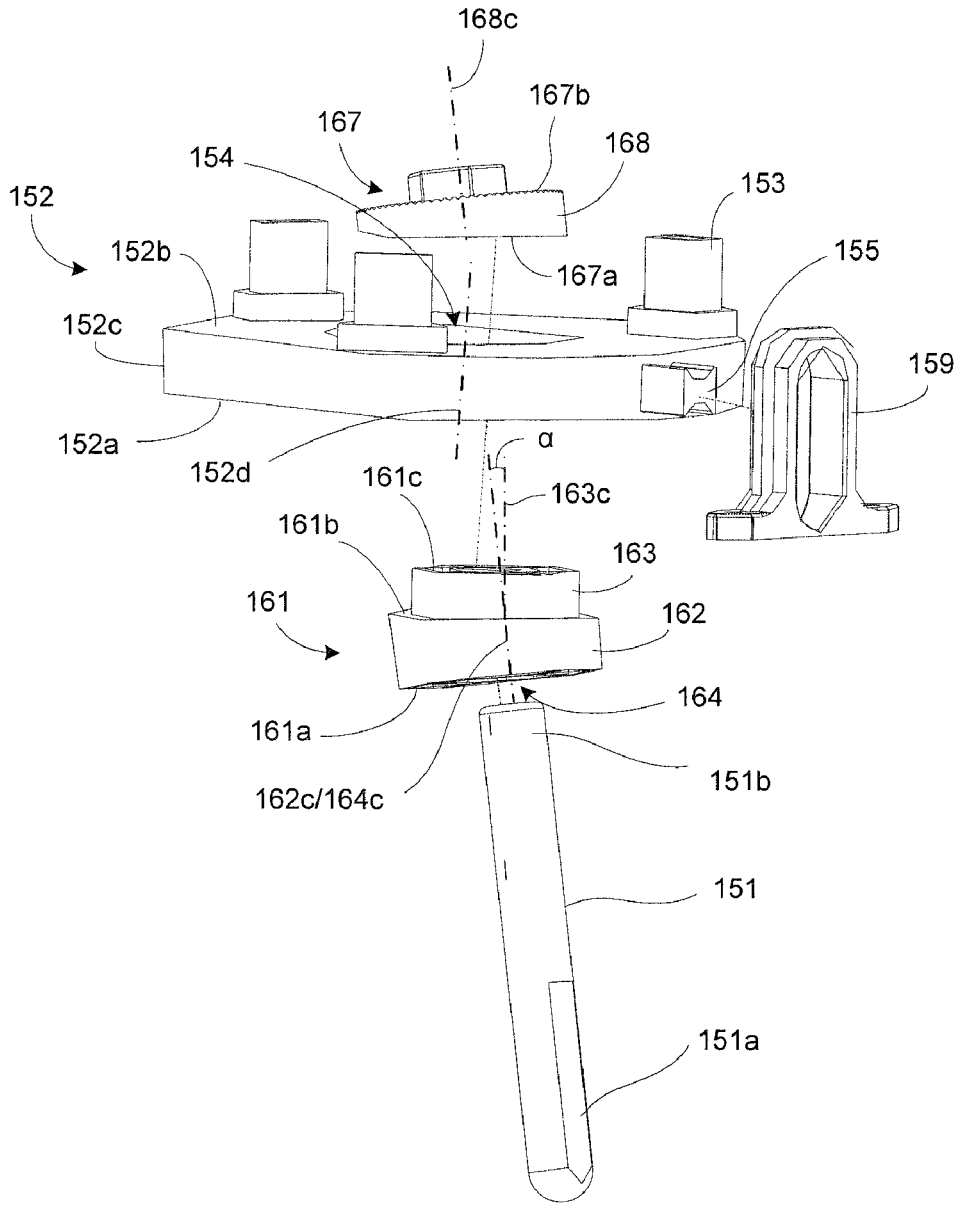
FIG. 2 shows a partially exploded view of the massage device as shown in FIG. 1.
Figure 3:
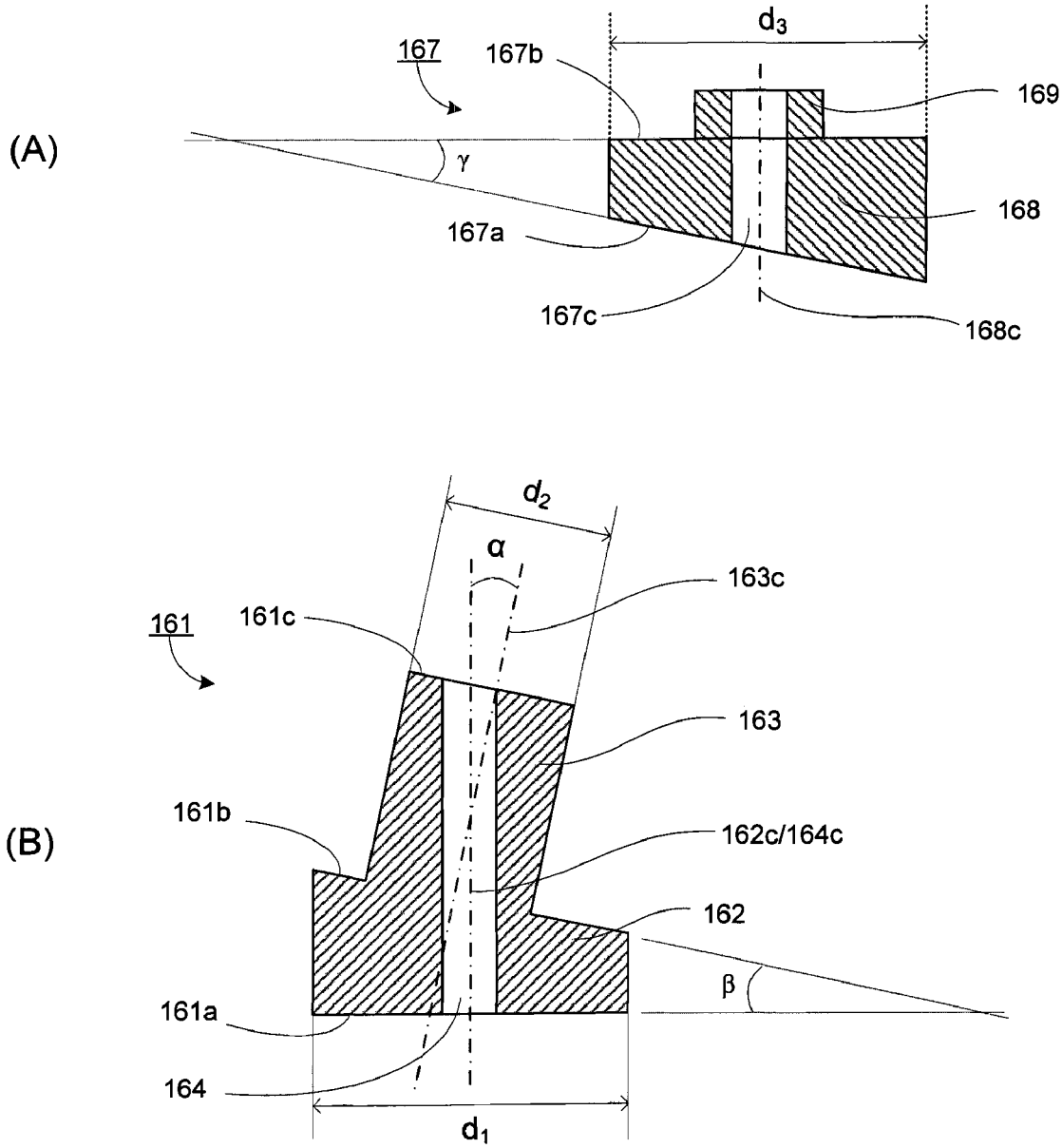
FIG. 3 shows a cross-sectional view of an eccentric block (A) and an eccentric wheel (B) utilized in the massage device as shown in FIG. 1.
Figure 4:
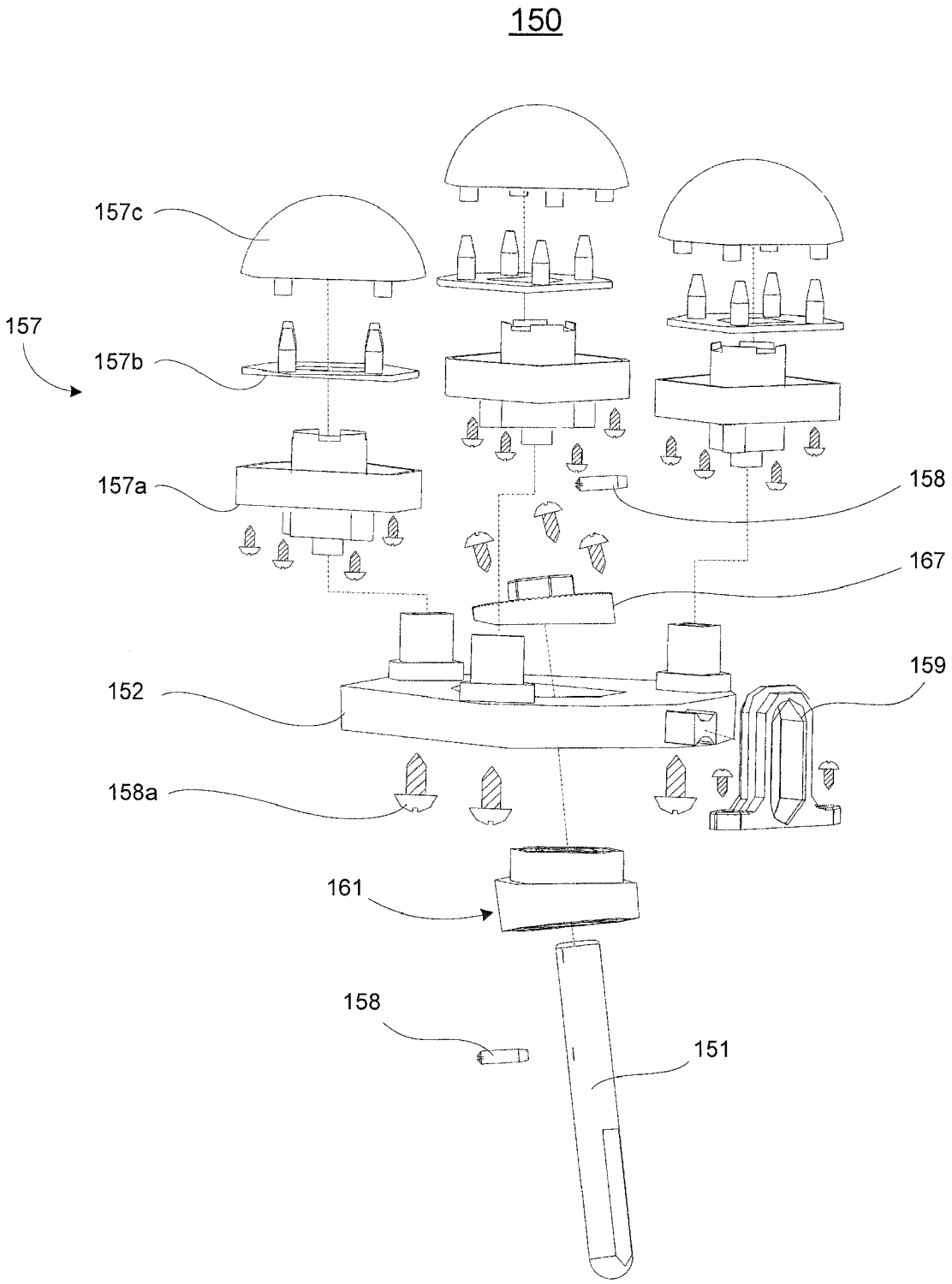
FIG. 4 shows another partially exploded view of the massage device as shown in FIG. 1.
Figure 5:
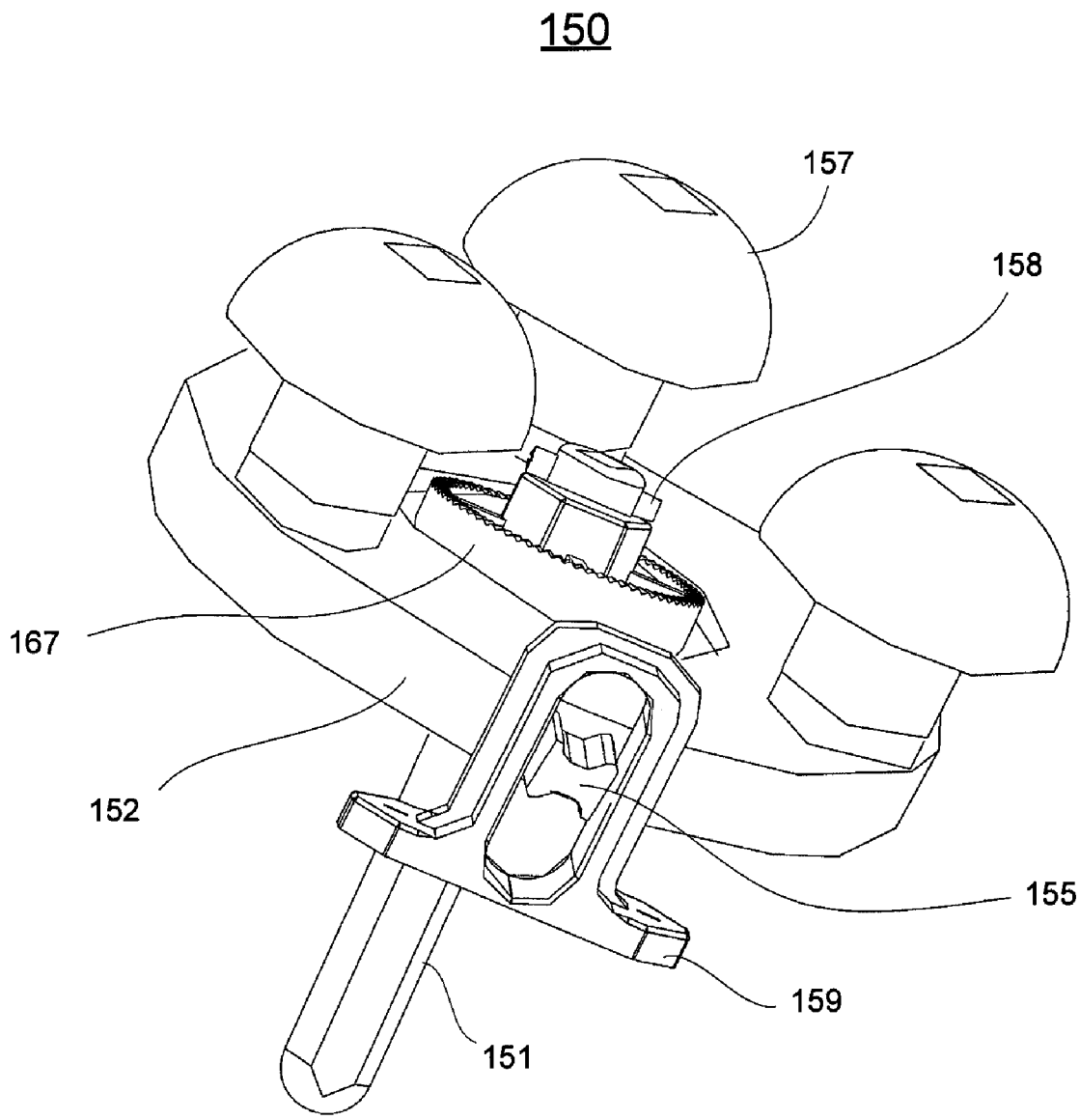
FIG. 5 shows a perspective view of a massage member utilized in the massage device as shown in FIG. 1.
Figure 6:
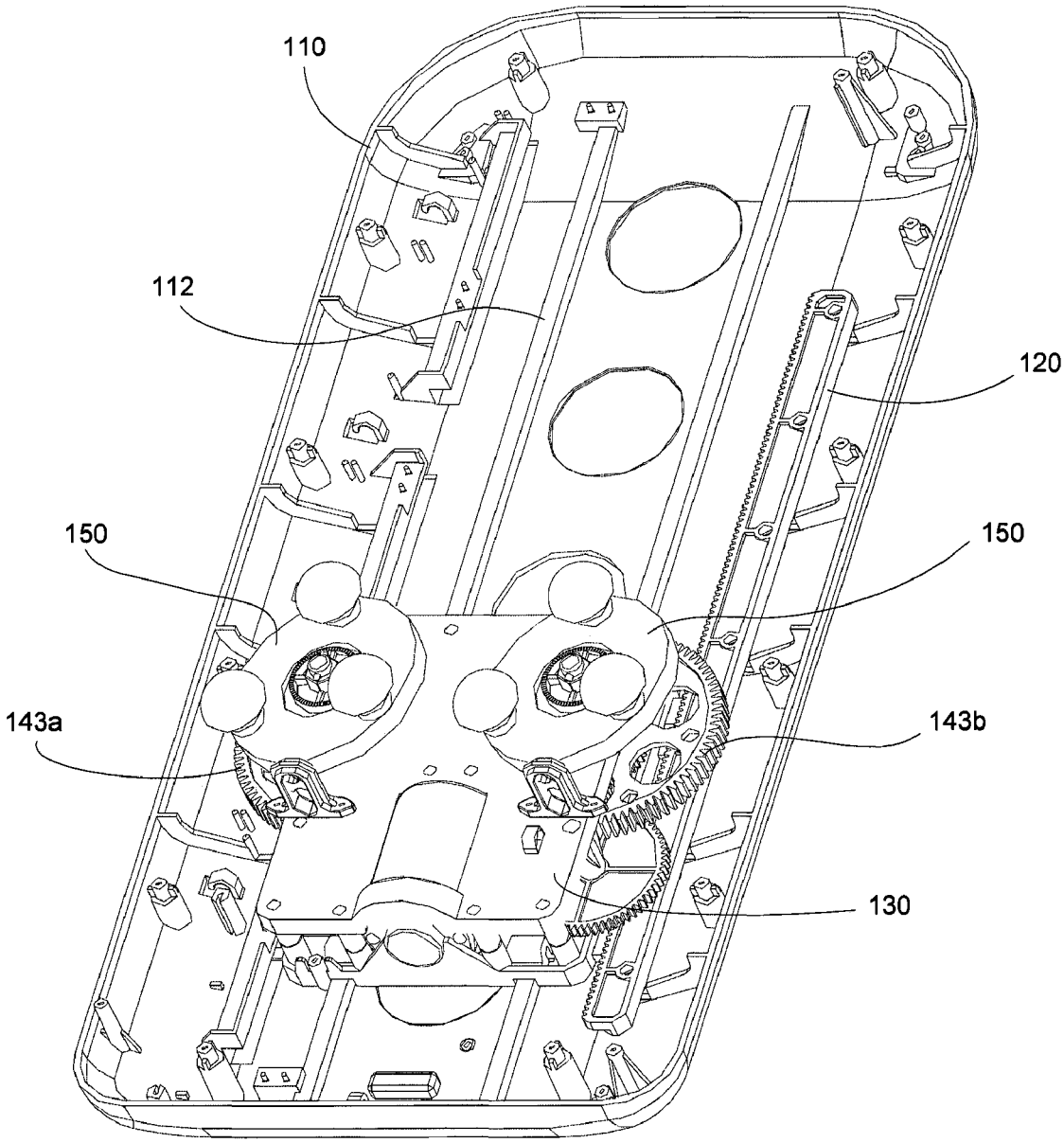
FIG. 6 shows a partially perspective view of the massage device as shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-11. In accordance with the purposes of this invention, as embodied and broadly described herein, this invention, in one aspect, relates to a massage device that utilizes a gyro mechanism to provide massaging effects.

Referring first to FIGS. 1-6, a massage device 100 is shown according to one embodiment of the present invention. The massage device 100 includes a base cover 110, a rack 120, a carriage 130, a transmission assembly 140 and a massage assembly having a pair of massage members 150.

The base cover 110 has a longitudinal axis 111 and two guiding rails 112 formed parallel to the longitudinal axis 111. The two guiding rails 112 are adapted for cooperating with the carriage 130 and translating the pair of massage members 150 along the longitudinal axis 111. Other numbers of guiding rails can also be utilized to practice the present invention. The rack 120 is mounted to the base cover 110 and paralleled to the plurality of guiding rails 112. The base cover 110 may also have a series of ribs 113 and supporting structures 114 for supporting and securing a top cover 118 to form a housing for accommodating the carriage 130, the transmission assembly 140 and the massage assembly therein. The base cover 110 is made of a durable material, such as wood, plastic, alloy or the like.

The carriage 130 includes a chassis member 131 and a shield member 132 placed over the chassis member 131 to form a chamber 133 therebetween. The chassis member 131 has two grooves 134 spaced-apart and formed on the bottom surface of the chassis member 131. The two grooves 134 are configured and sized to receive the two guiding rails 112 of the base cover 110, respectively. The cooperation of the guiding rails 112 of the base cover 110 and the grooves 134 of the chassis member 131 provides longitudinal guidance and support to the carriage 130 as it translates along the guiding rails 112. That is, when the carriage 130 is engaged with the base cover 110, the guiding rails 112 are respectively received in the grooves 134 of the chassis member 131 and the carriage 130 is longitudinally movable back and forth along the plurality of guiding rails 112 of the base cover 110. Other numbers of grooves can also be utilized to practice the present invention. The number of grooves is corresponding to the number of guiding rails formed in the base cover 110.

The transmission assembly 140 is received in the chamber 133 and secured in the carriage 130. The transmission assembly 140 has a motor 141 having an output shaft 141*a*, a worm 142 mechanically coupled with the output shaft 141*a* of the motor 141, a pair of worm wheels 143*a* and 143*b* meshing with the worm 142, a first gear 144 coaxially mounted under one of the pair of worm wheels 143*a* or 143*b*, a second gear 145 meshing with the first gear 144, a pinion gear 145*a* coaxially extended under the second gear 145, a third gear 146 meshing with the pinion gear 145*a*, and a driving gear 146*a* coaxially extended under the third gear 146 and meshing with the rack 120. Under this arrangement, when the motor 141 is activated, it drives the worm 142 to rotate, the rotation of the worm 142 results in, in turn, the rotations of the pair of worm wheels 143*a* and 143*b*, the first gear 144, the second gear 145, the pinion gear 145*a*, the third gear 146 and the driving gear 146*a*, accordingly, thereby moving the carriage 130 along the rack 120, i.e., the guiding rails 112 of the base cover 110.

The massage assembly has a pair of massage members 150. Each massage member 150 has a gear shaft 151, a driving member 160, a massage bracket 152, three massage heads 157, and a U-shape fixture 159.

The gear shaft 151 has a first end portion 151*a* and an opposite, second end portion 151*b*. The gear shaft 151 extends through the shield member 132 of the carriage 130 and is coaxially mounted to the corresponding worm wheel 143*a* or 143*b* by the first end portion 151*a*. In other words, when the worm wheel 143*a* or 143*b* rotate, it drives the corresponding gear shaft 151 to rotate accordingly.

The massage bracket 152 includes a first surface 152*a* and an opposite, second surface 152*b* defining a bracket body 152*c* therebetween, a central axis 152*d*, a protrusion 155 laterally extending from the bracket body 152*c*, and three stumps 153 spaced-apart on the first surface 152*b*. The bracket body 152*c* defines an opening 154 therethrough in the central region. Three massage heads 157 are respectively attached to three stumps 153 of the massage bracket 152.

In this embodiment as shown in FIGS. 1-6, each massage head 157 has a mushroom-shape. Each massage head 157 has a first structure 157*a*, a mushroom-shape node 157*c* and a second structure 157*b* placed between the first structure 157*a* and the mushroom-shape node 157*c*. Each massage head 157 may include an energy source capable of generating thermal energy. The source energy may include a lamp base mounted to the corresponding one of the plurality of stumps 153, a PCB board attached to the lamp base, and heating lamps attached onto the PCB board. For example, the first structure 157*a* and the first structure 157*a* of a massage head 157 can be parts of the source energy.

The driving member 160 includes an eccentric wheel 161 and an eccentric block 167. The eccentric wheel 161 has a first planar surface 161*a*, a second planar surface 161*b* tilted to the first planar surface 161*a* at an angle β, a third planar surface 161*c* parallel to the second planar surface 161*b*, a first cylindrical portion 162 defined between the first planar surface 161*a* and the second planar surface 161*b*, a second cylindrical portion 163 defined between the second planar surface 161*b* and the third planar surface 161*c*, and a shaft bore 164 defined through the first cylindrical portion 162 and the second cylindrical portion 163. The first cylindrical portion 162 has a central axis 162*c* substantially perpendicular to the first planar surface 161*a*, and a diameter, $d_1$. The second cylindrical portion 163 has a central axis 163*c* substantially perpendicular to the second planar surface 161*b* and defining an angle α, relative to the central axis 162*c* of the first cylindrical portion 162, and a diameter, $d_2$, less than the diameter $d_1$ of the first cylindrical portion 162. Each of the angles α and β is greater than zero but less than 90°, preferably, less than 45°. In this embodiment, β=α. The shaft bore 164 has a central axis 164*c* substantially coincident with the central axis 162*c* of the first cylindrical portion 162.

The eccentric block 167 has a first planar surface 167*a* and a second planar surface 167*b* defining a cylinder body 168 therebetween. the first planar surface 167*a* is tilted to the second planar surface 167*b* at an angle γ. The angle γ is greater than zero but less than 90°, preferably, less than 45°. In one embodiment, γ=α. The angles α, β and γ can also be chosen with other valves, same or different. The cylinder body 168 has a central axis 168*c* and a diameter, $d_3$, greater than the diameter $d_2$ of the second cylindrical portion 163 of the eccentric wheel 161. The eccentric block 167 may have a head portion 169 extending from the second surface 167*b*, and a shaft bore 167*c* defined therethrough. The shaft bore 167*c* and the cylinder body 168 are substantially coaxial.

As assembled, the three massage heads 157 are respectively attached to the three stumps 153 of the massage bracket 152. The second cylindrical portion 163 of the eccentric wheel 161 is received in the opening 154 of the massage bracket 152. The eccentric block 167 is then attached onto the second cylindrical portion 163 of the eccentric wheel 161 such that the first planar surface 167*a* of the eccentric block 167 is substantially in contact with and parallel to the third planar surface 161*c* of the eccentric wheel 161, the central axis 168*c* of the cylinder body 168 of the eccentric block 167 is substantially coincident with the central axis 162*c* of the first cylindrical portion 162 of the eccentric wheel 161, the central axis 152*d* of the massage bracket 152 is substantially coincident with the central axis 163*c* of the second cylinder portion 163 of the eccentric wheel 161, the massage bracket 152 operably cooperates with the second cylindrical portion 163 of the eccentric wheel 161, and the shaft bore 164 of the eccentric wheel 161 and the shaft bore 167*c* of the eccentric block 167 are substantially coaxial. Additionally, the protrusion 155 of the massage bracket is received in the U-shape fixture 159 that in turn, is mounted to the shield member 132 of the carriage 130. The second end portion 151*b* of the gear shaft 151 is then secured into the shaft bore 164 such that when the gear shaft 151 rotates, it drives the driving member 160 to rotate accordingly. Additionally, fastening means such as fastening pins 158 and screws 158*a* may be applied wherever it is needed to secure various components of the massage device 100.

For such a massage device 100, in operation, the motor 141 drives the pair of worm wheels 143*a* and 143*b* to rotate in opposed rotational directions, which in turn, drives the carriage 130 to move along the plurality of the guiding rails 112 of the base cover 110 and the driving member 160 of the massage assembly 150 to rotate. Since the protrusion 155 of the massage bracket 152 is placed in the U-shape fixture 159 that is mounted to the shield member 132 of the carriage 130, the rotation of the massage bracket 152 around the central axis 162*c* of the first cylindrical portion 162 of the eccentric wheel 160 is prohibited. Therefore, the rotation of the driving member 160 of the massage assembly 150 drives the massage bracket 152 to gyrate in a way so that its central axis 152*d* rotates around the central axis 162*c* of the first cylindrical portion 162 of the eccentric wheel 160 in the angle α. Such a gyro rotation of the massage bracket 152 causes the three massage heads 157 to move alternatively along a direction parallel to the central axis 162*c* of the first cylindrical portion 162 of the eccentric wheel 160. When the massage heads 157 are applied to parts of the body of a user, a simulated massaging effect is provided.

Referring now to FIGS. 7-11, a massage device 200 is shown according to another embodiment of the present invention. The massage device 200 includes a base cover 210, a rack 220, a carriage 230, a transmission assembly 240 and a massage assembly having a pair of massage members 250.

The base cover 210 has a longitudinal axis 211 and two guiding rails 212 formed parallel to the longitudinal axis 211. The two guiding rails 212 are adapted for cooperating with the carriage 230 and translating the pair of massage members 250 along the longitudinal axis 211. Other numbers of guiding rails can also be utilized to practice the present invention. The rack 220 is mounted to the base cover 210 and paralleled to the plurality of guiding rails 211. The base cover 210 may also have a series of ribs 213 and supporting structures 214 for supporting and securing a top cover 218 to form a housing for accommodating the carriage 230, the transmission assembly 240 and the massage assembly therein. The base cover 210 is made of a durable material, such as wood, plastic, alloy or the like.

The carriage 230 includes a chassis member 231 and a shield member 232 placed over the chassis member 231 to form a chamber 233 therebetween. The chassis member 231 has two grooves 234 spaced-apart formed on the bottom surface of the chassis member 231. The two grooves 234 are sized to receive the two guiding rails 212 of the base cover 210, respectively. The cooperation of the guiding rails 212 of the base cover 210 and the grooves 234 of the chassis member 231 provides longitudinal guidance and support to the carriage 230 as it translates along the guiding rails 212. The carriage 230 may also include a plurality of roller bearings 236, which are each pivotally connected to the carriage 230 and are offset from the grooves 234 and adjacent thereto for engaging a bearing surface provide upon each guiding rail 212 of the base cover 210. As the carriage 230 translates along the guiding rails 212, the carriage 230 is bearingly supported by the roller bearings 236 as they engage the surfaces provided by the guiding rails 212. Other numbers of grooves can also be utilized to practice the present invention. The number of grooves is corresponding to the number of guiding rails formed in the base cover 210.

Figure 7:
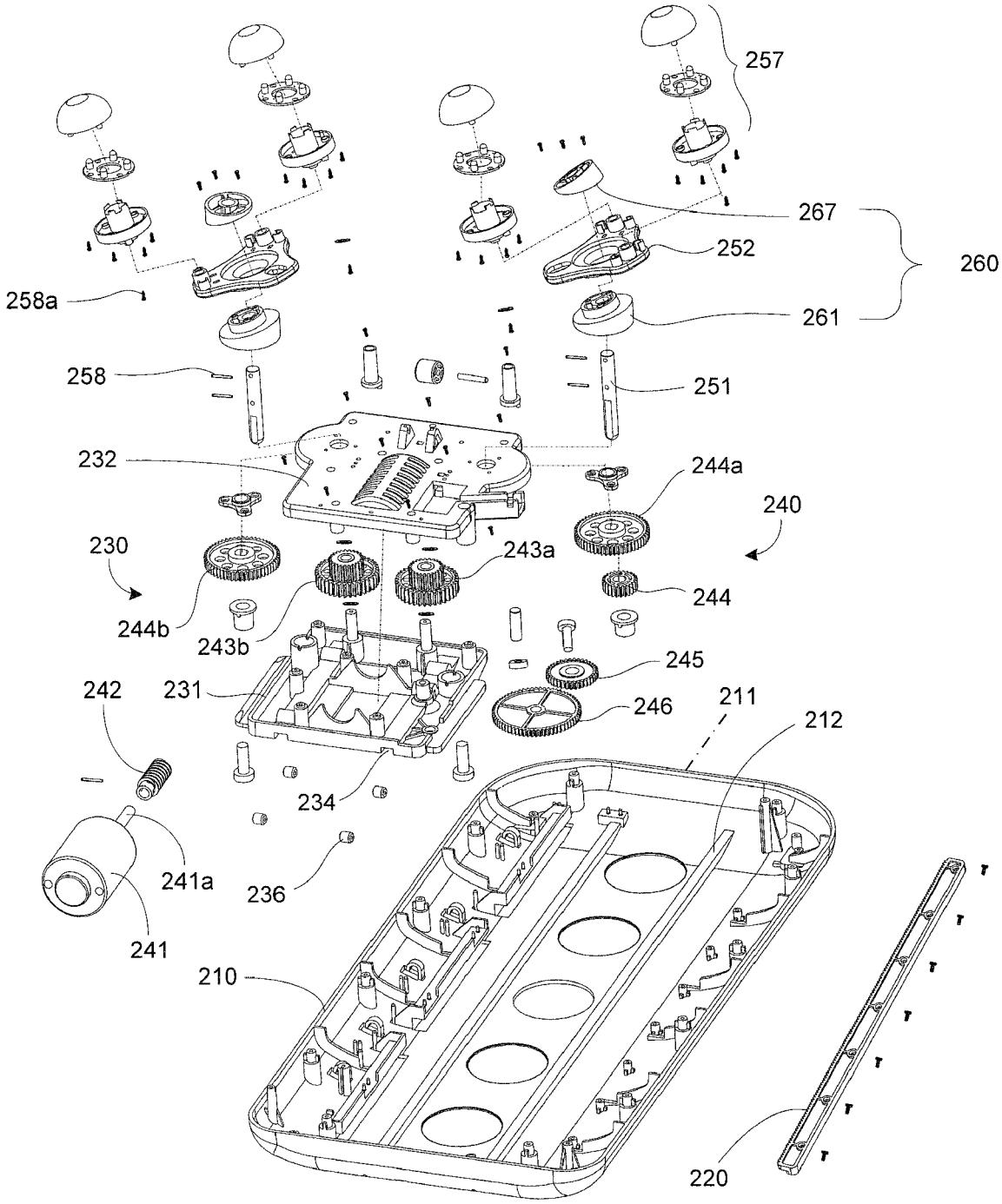
FIG. 7 shows a partially exploded view of a massage device according to another embodiment of the present invention.
Figure 8:
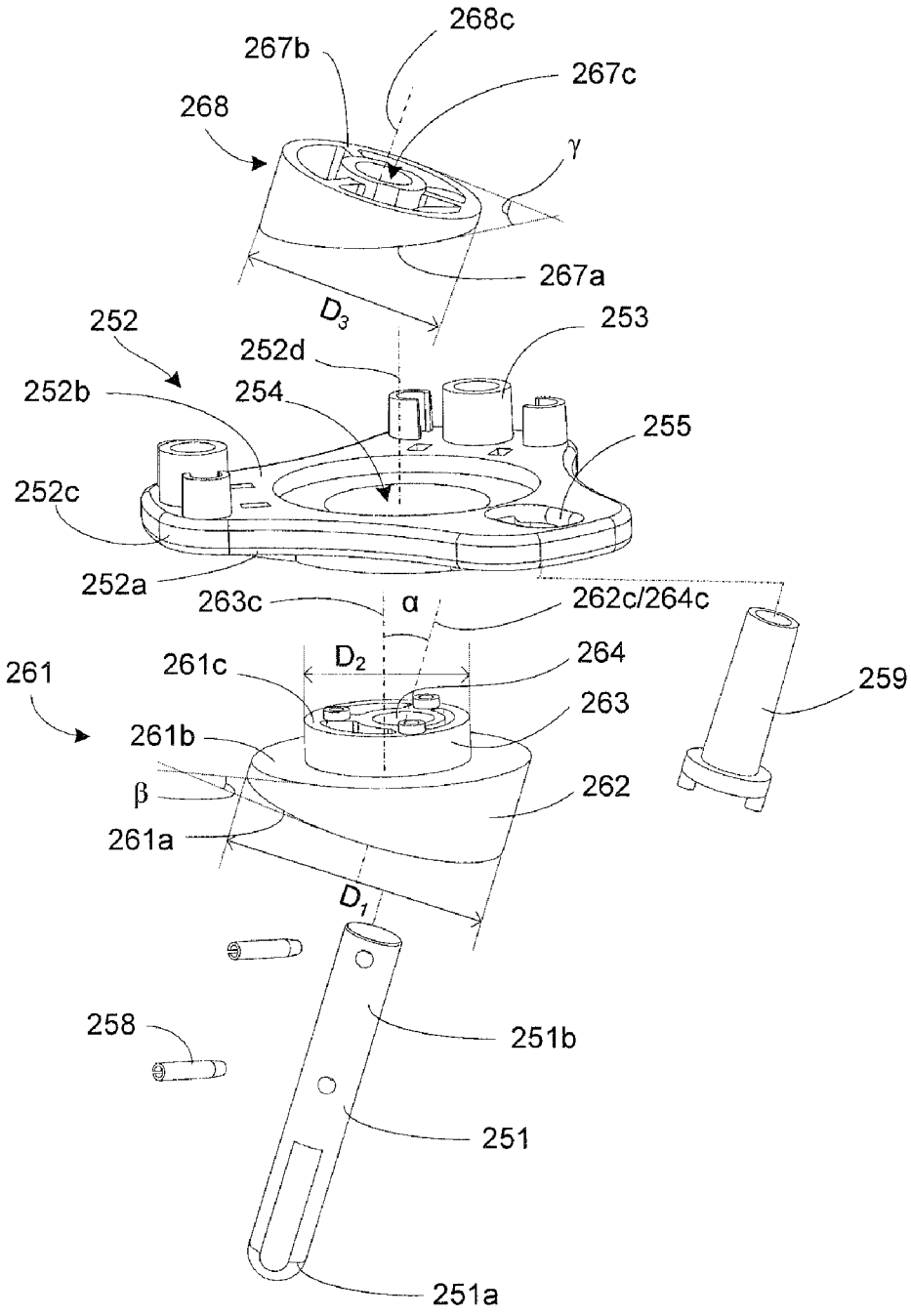
FIG. 8 shows another partially exploded view of the massage device as shown in FIG. 2.
Figure 9:
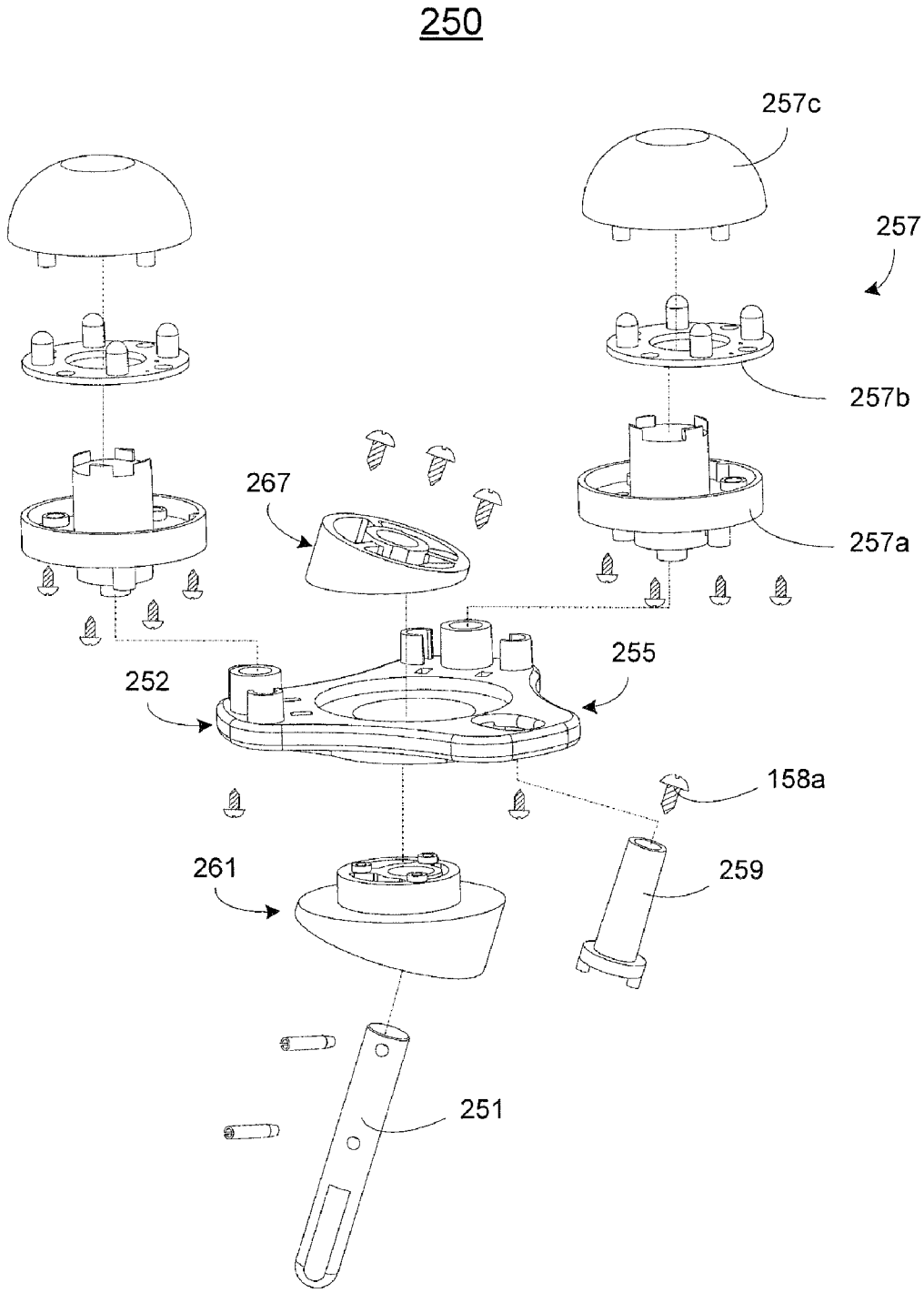
FIG. 9 shows yet another partially exploded view of the massage device as shown in FIG. 2.
Figure 10:
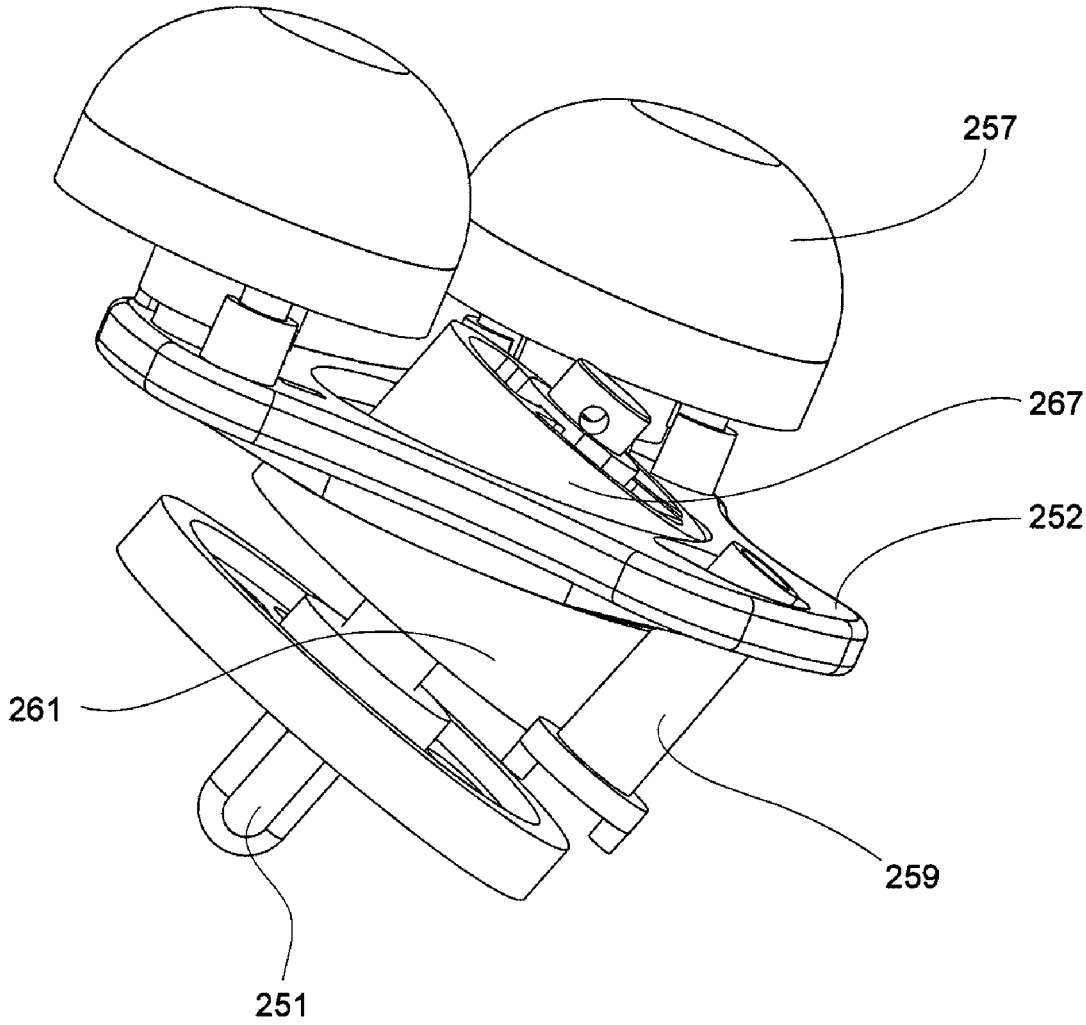
FIG. 10 shows a perspective view of a massage member utilized in the massage device as shown in FIG. 2.
Figure 11:
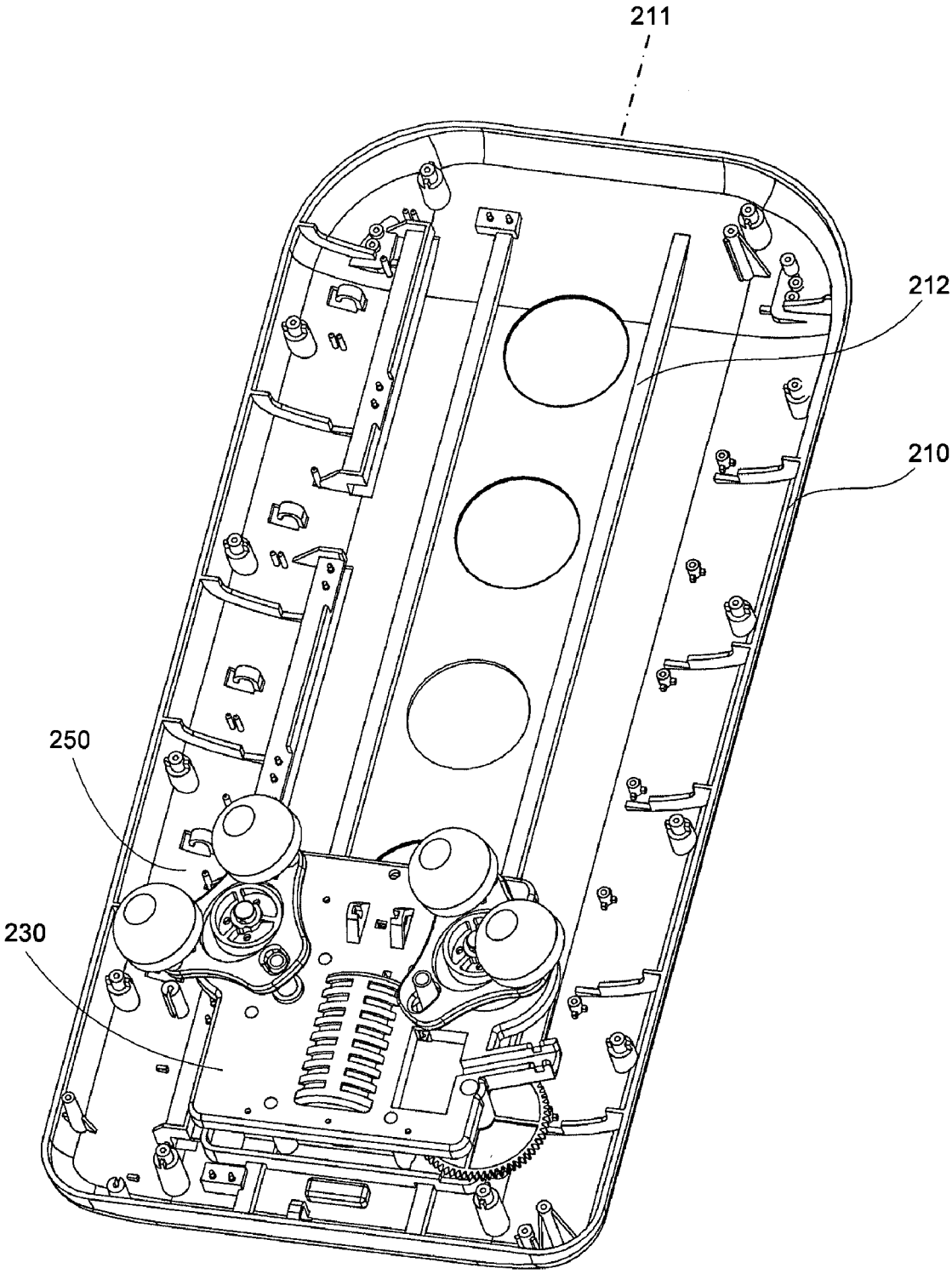
FIG. 11 shows a partially perspective view of the massage device as shown in FIG. 2.

The transmission assembly 240 is received in the chamber 233 and secured in the carriage 230. In this exemplary embodiment as shown in FIG. 7, the transmission assembly 240 includes a motor 241 having an output shaft 241*a*, a worm 242 mechanically coupled with the output shaft 241*a* of the motor 241, a pair of first worm wheels 243*a* and 243*b* meshing with the worm 242, a pair of second worm wheels 244*a* and 244*b* each meshing with a corresponding one of the pair of first worm wheels 243*a* and 243*b*, a first gear 244 coaxially mounted under one of the pair of second worm wheels 244*a* or 244*b*, a second gear 245 meshing with the first gear 244, a third gear 246 meshing with both the second gear 245 and the rack 220. Under this arrangement, when the motor 241 is activated, it drives the worm 242 to rotate, the rotation of the worm 242 results in, in turn, the rotations of the pair of first worm wheels 243*a* and 243*b*, the pair of second worm wheels 244*a* and 244*b*, the first gear 244, the second gear 245, the third gear 246, accordingly, thereby moving the carriage 230 along the plurality of the guiding rails of the base cover 210.

The massage assembly has a pair of massage members 250. Each massage member 250 includes a gear shaft 251, a driving member 260, a massage bracket 252, two massage heads 257 attached to the massage bracket 252, and a fixture bar 259 mounted to the carriage 230.

The gear shaft 251 having a first end portion 251*a* and an opposite, second end portion 251*b*. The gear shaft 251 extends through the shield member 232 of the carriage 230 and is coaxially mounted to a corresponding second worm wheel 244*a* or 244*b* by the first end portion 251*a*.

The massage bracket 252 includes a first surface 252*a* and an opposite, second surface 252*b* defining a bracket body 252*c* therebetween, a central axis 252*d* and a plurality of stumps 253 spaced-apart on the first surface 252*b*. The bracket body 252*c* defines a first opening 254 in the central region and a second opening 255 in a region apart from the central region. Two massage heads 257 are respectively attached to two stumps 253 of the massage bracket 252. Each massage head 257 has a mushroom-shape. In this embodiment, as shown in FIGS. 7-11, each massage head 257 has a first structure 257*a*, a mushroom-shape node 257*c* and a second structure 257*b* placed between the first structure 257*a* and the mushroom-shape node 257*c*. Additionally, each massage head 257 may include an energy source capable of generating thermal energy.

The driving member 260 has an eccentric wheel 261 and an eccentric block 267. The eccentric wheel 261 has a first planar surface 261*a*, a second planar surface 261*b* tilted to the first planar surface 261*a* at an angle β, a third planar surface 261*c* parallel to the second planar surface 261*b*, a first cylindrical portion 262 defined between the first planar surface 261*a* and the second planar surface 261*b*, a second cylindrical portion 263 defined between the second planar surface 261*b* and the third planar surface 261*c*, and a shaft bore 264 defined through the first cylindrical portion 262 and the second cylindrical portion 263, where the first cylindrical portion 262 has a central axis 262*c* substantially perpendicular to the first planar surface 261*a*, and a diameter, $D_1$, where the second cylindrical portion 263 has a central axis 263*c* substantially perpendicular to the second planar surface 261*b* and defining an angle α, relative to the central axis 262*c* of the first cylindrical portion 262, and a diameter, $D_2$, less than the diameter $D_1$ of the first cylindrical portion 262. Each of the angles α and β is greater than zero but less than 90°, preferably, less than 45°. In one embodiment, β=α. The shaft bore 264 has a central axis 264*c* substantially coincident with the central axis 262*c* of the first cylindrical portion 262.

The eccentric block 267 has a first planar surface 267*a* and a second planar surface 267*b* defining a cylinder body 268 therebetween. the first planar surface 267*a* is tilted to the second planar surface 267*b* at an angle γ. The angle γ is greater than zero but less than 90°, preferably, less than 45°. In one embodiment, γ=α. Again, the angles α, β and γ can also be chosen with other values, same or different. The cylinder body 268 has a central axis 268*c* and a diameter, $d_3$, greater than the diameter $d_2$ of the second cylindrical portion 263 of the eccentric wheel 261. The eccentric block 267 may have a shaft bore 267*c* defined therethrough. The shaft bore 267*c* and the cylinder body 268 are substantially coaxial.

As assembled, the three massage heads 257 are respectively attached to the three stumps 253 of the massage bracket 252. The second cylindrical portion 263 of the eccentric wheel 261 is received in the first opening 254 of the massage bracket 252. The eccentric block 267 is then attached onto the second cylindrical portion 263 of the eccentric wheel 261 such that the first planar surface 267*a* of the eccentric block 267 is substantially in contact with and parallel to the third planar surface 261*c* of the eccentric wheel 261, the central axis 268*c* of the cylinder body 268 of the eccentric block 267 is substantially coincident with the central axis 262*c* of the first cylindrical portion 262 of the eccentric wheel 260, the central axis 252*d* of the massage bracket 252 is substantially coincident with the central axis 263*c* of the second cylinder portion 263 of the eccentric wheel 260, the massage bracket 252 operably cooperates with the second cylindrical portion 263 of the eccentric wheel 261, and the shaft bore 264 of the eccentric wheel 261 and the shaft bore 267*c* of the eccentric block 267 are substantially coaxial. Additionally, the fixture bar 259 places into the second opening 255 of the massage bracket 252 and is mounted to the shield member 232 of the carriage 230. The second end portion 251*b* of the gear shaft 251 is then secured into the shaft bore 264 such that when the gear shaft 251 rotates, it drives the driving member 260 to rotate accordingly. Additionally, fastening means such as fastening pins 258 and screws 258*a* may be applied wherever it is needed to secure various components of the massage device 200.

For the massage device 200, in operation, the motor 241 drives the pair of first worm wheels 243*a* and 243*b* to rotate in opposed rotational directions, which in turn, drives the carriage 230 to move along the plurality of the guiding rails 212 of the base cover 210 and the driving member 260 of the massage assembly 250 to rotate. Since the second opening 255 of the massage bracket 252 receives in the fixture bar 259 that is mounted to the shield member 234 of the carriage 230, the rotation of the massage bracket 252 around the central axis 262*c* of the first cylindrical portion 262 of the eccentric wheel 260 is prohibited. Therefore, the rotation of the driving member 260 of the massage assembly 250 will drive the massage bracket 252 to gyrate in a way so that its central axis 252*d* rotates around the central axis 262*c* of the first cylindrical portion 262 of the eccentric wheel 260 in the angle α. Such a gyro rotation of the massage bracket 252 causes the two massage heads 257 to move alternatively along a direction parallel to the central axis 262*c* of the first cylindrical portion 262 of the eccentric wheel 260. When the massage heads 257 are applied to parts of the body of a user, a simulated massaging effect is provided.

One aspect of the present invention provides a massage assembly usable for a massage device. In one embodiment, the massage assembly includes a wheel member having a first surface, a second surface tilted at least to a part of the first surface, a third surface, a first body portion defined between the first surface and the second surface, a second body portion defined between the second surface and the third surface, and a shaft bore defined through the first body portion and the second body portion. The first body portion has a central axis relative to the first surface. The second body portion has a central axis relative to the second surface and defining an angle α relative to the central axis of the first body portion. The shaft bore has a central axis substantially coincident with the central axis of the first body portion.

The massage assembly also includes a block member that has a first surface that is configured to cooperate with the third surface of the wheel member and a second surface defining a body portion therebetween. The body portion has a central axis, and the first surface is tilted at least to a part of the second surface.

The massage assembly also further includes a massage bracket and at least one massage head. The massage bracket has a first surface and an opposite, second surface defining a bracket body therebetween, a central axis and at least one stump on the first surface. The bracket body defines an opening therethrough.

As assembled, the at least one massage head is attached to the at least one stump of the massage bracket, the second body portion of the wheel member is received in the opening of the massage bracket, the block member is mounted to the second body portion of the wheel member such that the first surface of the block member is in contact with the third surface of the wheel member, the central axis of the body portion of the block member is substantially coincident with the central axis of the first body portion of the wheel member, the central axis of the massage bracket is substantially coincident with the central axis of the second body portion of the wheel member, and the massage bracket operably cooperates with the second body portion of the wheel member.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A massage device, comprising:

a. a base cover having a longitudinal axis and a plurality of guiding rails formed parallel to the longitudinal axis;

b. a rack mounted to the base cover and paralleled to the plurality of guiding rails;

c. a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover;

d. a transmission assembly received in the chamber and secured in the carriage, having a motor having an output shaft, a worm mechanically coupled with the output shaft of the motor, a pair of worm wheels meshing with the worm, a first gear coaxially mounted under one of the pair of worm wheels, a second gear meshing with the first gear, a pinion gear coaxially extended under the second gear, a third gear meshing with the pinion gear, and a driving gear coaxially extended under the third gear and meshing with the rack such that when the motor is activated, it drives the worm to rotate, the rotation of the worm results in, in turn, the rotations of the pair of worm wheels, the first gear, the second gear, the pinion gear, the third gear and the driving gear, thereby moving the carriage along the plurality of the guiding rails of the base cover; and e. a massage assembly having a pair of massage members, each massage member comprising:

(i). a gear shaft having a first end portion and an opposite, second end portion, wherein the gear shaft extends through the shield member of the carriage and is coaxially mounted to the corresponding worm wheel by the first end portion;

(ii). a driving member having an eccentric wheel and an eccentric block, wherein the eccentric wheel has a first planar surface, a second planar surface tilted to the first planar surface at an angle β, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, $d_1$, wherein the second cylindrical portion has a central axis substantially perpendicular to the second planar surface and defining an angle α relative to the central axis of the first cylindrical portion, and a diameter, $d_2$, less than the diameter $d_1$ of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, $d_3$, greater than the diameter $d_2$ of the second cylindrical portion of the eccentric wheel, and the first planar surface is tilted to the second planar surface at an angle γ;

(iii). a massage bracket having a first surface and an opposite, second surface defining a bracket body therebetween, a central axis, a protrusion laterally extending from the bracket body, and a plurality of stumps spaced-apart on the first surface, wherein the bracket body defines an opening therethrough;

(iv). a plurality of massage heads; and (v). a U-shape fixture, wherein as assembled, the plurality of massage heads is attached to the plurality of stumps of the massage bracket, respectively, the second cylindrical portion of the eccentric wheel is received in the opening of the massage bracket, the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel, the protrusion of the massage bracket is received in the U-shape fixture, which is mounted to the shield member of the carriage; and the second end portion of the gear shaft is received in the shaft bore.

2. The massage device of claim 1, wherein in operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle α, thereby causing the plurality of massage heads to move alternatively along a direction parallel to the central axis of the first cylindrical portion of the eccentric wheel so as to provide a massage effect to a user.

3. The massage device of claim 1, wherein each of the angles α, β and γ is greater than zero but less than 90°.

4. The massage device of claim 3, wherein β=α and γ=α.

5. The massage device of claim 1, wherein each of the plurality of massage heads has a mushroom-shape.

6. The massage device of claim 5, wherein each of the plurality of massage heads comprises a first structure, a mushroom-shape node and a second structure placed between the first structure and the mushroom-shape node.

7. The massage device of claim 1, wherein each of the plurality of massage heads comprises an energy source of capable of generating thermal energy.

8. The massage device of claim 7, wherein the energy source comprises a lamp base mounted to a corresponding one of the plurality of stumps, a PCB board attached to the lamp base, and heating lamps attached onto the PCB board.

9. A massage device, comprising:

a. a base cover having a longitudinal axis and a plurality of guiding rails formed parallel to the longitudinal axis;

b. a rack mounted to the base cover and paralleled to the plurality of guiding rails;

c. a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover;

d. a transmission assembly received in the chamber and secured in the carriage, having a motor having an output shaft, a worm mechanically coupled with the output shaft of the motor, a pair of first worm wheels meshing with the worm, a pair of second worm wheels each meshing with one of the pair of first worm wheels, a first gear coaxially mounted under one of the pair of second worm wheels, a second gear meshing with the first gear, a third gear meshing with both the second gear and the rack such that when the motor is activated, it drives the worm to rotate, the rotation of the worm results in, in turn, the rotations of the pair of first worm wheels, the pair of second worm wheels, the first gear, the second gear, and the third gear, thereby moving the carriage along the plurality of the guiding rails of the base cover; and e. a massage assembly having a pair of massage members, each massage member comprising:

(i). a gear shaft having a first end portion and an opposite, second end portion, wherein the gear shaft extends through the shield member of the carriage and is coaxially mounted to a corresponding second worm wheel by the first end portion;

(ii). a driving member having an eccentric wheel and an eccentric block, wherein the eccentric wheel has a first planar surface, a second planar surface tilted to the first planar surface at an angle β, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, $D_1$, wherein the second cylindrical portion has a central axis substantially perpendicular to the second planar surface and defining an angle α relative to the central axis of the first cylindrical portion, and a diameter, $D_2$, less than the diameter $D_1$ of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, $D_3$, greater than the diameter $D_2$ of the second cylindrical portion of the eccentric wheel, and the first planar surface is tilted to the second planar surface at an angle γ;

(iii). a massage bracket having a first surface and an opposite, second surface defining a bracket body therebetween, a central axis and a plurality of stumps spaced-apart on the first surface, wherein the bracket body defines a first opening in the central region and a second opening in a region apart from the central region;

(iv). a plurality of massage heads; and (v). a fixture bar, wherein as assembled, the plurality of massage heads is attached to the plurality of stumps of the massage bracket, respectively, the second cylindrical portion of the eccentric wheel is received in the first opening of the massage bracket, the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel and the central axis of the massage bracket is substantially coincident with the central axis of the second cylinder portion of the eccentric wheel, and the massage bracket operably cooperates with the second cylindrical portion of the eccentric wheel, the fixture bar is received in the second opening of the massage bracket and mounted to the shield member of the carriage at its one end; and the second end portion of the gear shaft is received in the shaft bore.

10. The massage device of claim 9, wherein in operation, the motor drives the pair of first worm wheels to rotate in opposed rotational directions, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle α, thereby causing the plurality of massage heads to move alternatively along a direction parallel to the central axis of the first cylindrical portion of the eccentric wheel so as to provide a massage effect to a user.

11. The massage device of claim 9, wherein each of the plurality of massage heads has a mushroom-shape.

12. The massage device of claim 11, wherein each of the plurality of massage heads comprises a first structure, a mushroom-shape node and a second structure placed between the first structure and the mushroom-shape node.

13. The massage device of claim 9, wherein each of the plurality of massage heads comprises an energy source of capable of generating thermal energy.

14. The massage device of claim 13, wherein the energy source comprises a lamp base mounted to a corresponding one of the plurality of stumps, a PCB board attached to the lamp base, and heating lamps attached onto the PCB board.

15. A massage device, comprising:

a. a massage assembly having a pair of massage members, each massage member comprising:

(i). a driving member having an eccentric wheel and an eccentric block, wherein the eccentric wheel has a first planar surface, a second planar surface tilted to the first planar surface at an angle β, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, $d_1$, wherein the second cylindrical portion has a central axis substantially perpendicular to the second planar surface and defining an angle α relative to the central axis of the first cylindrical portion, and a diameter, $d_2$, less than the diameter $d_1$ of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, $d_3$, greater than the diameter $d_2$ of the second cylindrical portion of the eccentric wheel, and the first planar surface is tilted to the second planar surface at an angle γ;

(ii). a massage bracket having a first surface and an opposite, second surface defining a bracket body therebetween, a central axis and a plurality of stumps spaced-apart on the first surface, wherein the bracket body defines an opening therethrough in the central region; and (iii). a plurality of massage heads, wherein as assembled, the plurality of massage heads is attached to the plurality of stumps of the massage bracket, respectively, the second cylindrical portion of the eccentric wheel is received in the opening of the massage bracket; the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel, and b. a transmission assembly adapted for driving the plurality of massage heads to move alternatively along a first direction parallel to the central axis of the first cylindrical portion of the eccentric wheel, while translating the massage assembly along a second direction perpendicular to the first direction.

16. The massage device of claim 15, further comprising:

a. a base cover having a longitudinal axis and a plurality of guiding rails formed parallel to the longitudinal axis;

b. a rack mounted to the base cover and paralleled to the plurality of guiding rails; and c. a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

17. The massage device of claim 16, wherein the transmission assembly is received in the chamber and secured in the carriage, and comprises a motor having an output shaft, a worm mechanically coupled with the output shaft of the motor, a pair of worm wheels meshing with the worm, a first gear coaxially mounted under one of the pair of worm wheels, a second gear meshing with the first gear, a pinion gear coaxially extended under the second gear, a third gear meshing with the pinion gear, and a driving gear coaxially extended under the third gear and meshing with the rack such that when the motor is activated, it drives the worm to rotate, the rotation of the worm results in, in turn, the rotations of the pair of worm wheels, the first gear, the second gear, the pinion gear, the third gear and the driving gear, thereby moving the carriage along the plurality of the guiding rails of the base cover.

18. The massage device of claim 17, wherein each massage member further comprises a gear shaft having a first end portion and an opposite, second end portion, wherein the gear shaft extends through the shield member of the carriage and is coaxially mounted to the corresponding worm wheel by the first end portion, while received in the shaft bore of the eccentric wheel by the second end portion.

19. The massage device of claim 16, wherein each massage member further comprises means for limiting the massage bracket from rotating along the central axis of the first cylindrical portion of the eccentric wheel.

20. The massage device of claim 19, wherein the limiting means comprises a U-shape fixture or a fixture bar mounted to the shield member of the carriage.

21. The massage device of claim 19, wherein in operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

22. The massage device of claim 15, wherein each of the plurality of massage heads comprises an energy source of capable of generating thermal energy.

23. A massage assembly usable for a massage device, comprising:

a. an eccentric wheel having a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, $d_1$, wherein the second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion, and wherein the shaft bore has a central axis substantially coincident with the central axis of the first cylindrical portion;

b. an eccentric block has a first planar surface and a second planar surface defining a cylinder body therebetween, wherein the cylinder body has a central axis and a diameter, $d_3$, greater than the diameter $d_2$ of the second cylindrical portion of the eccentric wheel, and the first planar surface is tilted to the second planar surface at an angle $\gamma$;

c. a massage bracket having a first surface and an opposite, second surface defining a bracket body therebetween, a central axis and a plurality of stumps spaced-apart on the first surface, wherein the bracket body defines an opening therethrough in the central region; and d. a plurality of massage heads, wherein as assembled, the plurality of massage heads is attached to the plurality of stumps of the massage bracket, respectively, the second cylindrical portion of the eccentric wheel is received in the opening of the massage bracket; the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

24. The massage assembly of claim 23, further comprising means for limiting the massage bracket from rotating along the central axis of the first cylindrical portion of the eccentric wheel.

25. The massage assembly of claim 24, wherein the limiting means comprises a U-shape fixture or a fixture bar.

26. The massage assembly of claim 23, wherein each of the plurality of massage heads has a mushroom-shape.

27. The massage assembly of claim 23, wherein each of the plurality of massage heads comprises an energy source of capable of generating thermal energy.

28. A massage assembly usable for a massage device, comprising:

a. a wheel member having a first surface, a second surface tilted at least to a part of the first surface, a third surface, a first body portion defined between the first surface and the second surface, a second body portion defined between the second surface and the third surface, and a shaft bore defined through the first body portion and the second body portion, wherein the first body portion has a central axis relative to the first surface, wherein the second body portion has a central axis relative to the second surface and defining an angle $\alpha$, relative to the central axis of the first body portion, and wherein the shaft bore has a central axis substantially coincident with the central axis of the first body portion;

b. a block member having a first surface that is configured to cooperate with the third surface of the wheel member and a second surface defining a body portion therebetween, wherein the body portion has a central axis, and the first surface is tilted at least to a part of the second surface;

c. a massage bracket having a first surface and an opposite, second surface defining a bracket body therebetween, a central axis and at least one stump on the first surface, wherein the bracket body defines an opening therethrough; and d. at least one massage head, wherein as assembled, the at least one massage head is attached to the at least one stump of the massage bracket, the second body portion of the wheel member is received in the opening of the massage bracket, the block member is mounted to the second body portion of the wheel member such that the first surface of the block member is in contact with the third surface of the wheel member, the central axis of the body portion of the block member is substantially coincident with the central axis of the first body portion of the wheel member, the central axis of the massage bracket is substantially coincident with the central axis of the second body portion of the wheel member, and the massage bracket operably cooperates with the second body portion of the wheel member.

* * * * *